US011591188B2

(12) United States Patent
Watson et al.

(10) Patent No.: US 11,591,188 B2
(45) Date of Patent: Feb. 28, 2023

(54) ELEVATOR SYSTEM ROPING ARRANGEMENT

(71) Applicant: Otis Elevator Company, Farmington, CT (US)

(72) Inventors: Benjamin J. Watson, Burlington, CT (US); Daryl J. Marvin, Farmington, CT (US)

(73) Assignee: Otis Elevator Company, Farmington, CT (US)

( * ) Notice: Subject to any disclaimer, the term of this patent is extended or adjusted under 35 U.S.C. 154(b) by 0 days.

(21) Appl. No.: 16/944,998

(22) Filed: Jul. 31, 2020

(65) Prior Publication Data

US 2020/0354195 A1 Nov. 12, 2020

Related U.S. Application Data

(62) Division of application No. 15/540,627, filed as application No. PCT/US2015/065220 on Dec. 11, 2015, now abandoned.

(60) Provisional application No. 62/098,564, filed on Dec. 31, 2014.

(51) Int. Cl.

| | |
|---|---|
| ***B66B 11/08*** | (2006.01) |
| ***B66B 9/00*** | (2006.01) |
| ***B66B 11/00*** | (2006.01) |
| ***B66B 5/00*** | (2006.01) |
| ***B66B 11/04*** | (2006.01) |

(52) U.S. Cl.

CPC ..... *B66B 11/08* (2013.01); *B66B 5/0018* (2013.01); *B66B 9/00* (2013.01); *B66B 11/008* (2013.01); *B66B 11/0045* (2013.01); *B66B 11/043* (2013.01)

(58) Field of Classification Search

CPC ..... B66B 11/08; B66B 11/043; B66B 11/008

See application file for complete search history.

(56) References Cited

U.S. PATENT DOCUMENTS

| | | | |
|---|---|---|---|
| 646,918 | A | 4/1900 | Reynolds |
| 6,021,872 | A | 2/2000 | Sevilleja et al. |
| 6,085,874 | A | 7/2000 | Uchino et al. |
| 6,193,016 | B1 | 2/2001 | Hollowell et al. |

(Continued)

FOREIGN PATENT DOCUMENTS

| | | | |
|---|---|---|---|
| CN | 1589228 | A | 3/2005 |
| CN | 1953922 | A | 4/2007 |

(Continued)

OTHER PUBLICATIONS

International Search Report issued in PCT/US2015/065220, dated Mar. 23, 2016.

(Continued)

*Primary Examiner* — Diem M Tran

(74) *Attorney, Agent, or Firm* — Locke Lord LLP; Joshua L. Jones; Gabrielle L. Gelozin

(57) ABSTRACT

An elevator system includes an elevator car. A first drive assembly engages a first tension member. The first tension member is coupled to the elevator car and to a first counterweight. A second drive assembly engages a second tension member. The second tension member is coupled to the elevator car and to a second counterweight. The first tension member can be coupled to the elevator car at a first position and the second tension member can be coupled to the elevator car at a second position opposite the first position.

8 Claims, 6 Drawing Sheets

(56) References Cited

U.S. PATENT DOCUMENTS

| | | | |
|---|---|---|---|
| 7,503,433 | B2 | 3/2009 | Wang |
| 2006/0000166 | A1 | 1/2006 | Koeppe |
| 2006/0001917 | A1 | 8/2006 | Mustalahti et al. |
| 2008/0002236 | A1 | 9/2008 | Cuthbert |
| 2011/0002780 | A1 | 11/2011 | Ketonen et al. |
| 2013/0306408 | A1 | 11/2013 | Jacobs |
| 2014/0353089 | A1 | 12/2014 | Shani et al. |
| 2015/0158702 | A1 | 6/2015 | Dudde et al. |

FOREIGN PATENT DOCUMENTS

| | | | |
|---|---|---|---|
| CN | 101108710 | A | 1/2008 |
| CN | 100522781 | C | 8/2009 |
| CN | 202658931 | U | 1/2013 |
| CN | 103626014 | A | 3/2014 |
| CN | 103608280 | B | 8/2016 |
| EP | 1006071 | A1 | 6/2000 |
| EP | 1074503 | A2 | 2/2001 |
| EP | 1591399 | A1 | 11/2005 |
| EP | 1767483 | A1 | 3/2007 |
| JP | H03256986 | A | 11/1991 |
| JP | 2006327704 | A | 12/2006 |
| KR | 20070004491 | A | 1/2007 |
| WO | 9943593 | A1 | 9/1999 |
| WO | 2004067428 | A1 | 8/2004 |

OTHER PUBLICATIONS

Chinese Office Action and Search Report dated Aug. 28, 2018, and English translation thereof, issued during the prosecution of Chinese Patent Application No. CN 201580072046.7 (19 pages).

Chinese Office Action dated Mar. 6, 2019, issued during the prosecution of Chinese Patent Application No. CN 201580072046.7 (8 pages).

Chinese Office Action dated Jun. 6, 2019, (No. English Translation available), issued on a counterpart Chinese Application No. CN 1589228 .

EP Communication pursuant to Article 94(3) EPC dated Dec. 11, 2019, issued during the prosecution of European Patent Application No. EP 15817711.3.

ELEVATOR SYSTEM ROPING ARRANGEMENT

CROSS-REFERENCE TO RELATED APPLICATIONS

This application is a divisional of U.S. patent application Ser. No. 15/540,627 filed Jun. 29, 2017, which is a national phase of PCT Application No. PCT/US2015/065220, filed on Dec. 11, 2015, which PCT application claims the benefit of and priority to U.S. Provisional Patent Application No. 62/098,564, filed Dec. 31, 2014. The entire contents of these applications are incorporated herein by reference in their entireties.

BACKGROUND OF THE INVENTION

1. Field of the Invention

The present disclosure relates to elevators, and more particularly to roping systems for use with elevator cars.

2. Description of Related Art

Elevator systems include roping arrangements supporting elevator cars and counterweights within hoistways. The typical roping arrangement provides the ability to position an elevator car as desired in the hoistway. In some applications, a simple 1:1 roping configuration is sufficient where a tension member is connected to a counterweight such that the counterweight travels as far as the elevator car in the opposite direction. In other applications, a 2:1 roping configuration is used where a tension member wraps around a sheave on a counterweight and a sheave on an elevator car such that the tension member moves twice as fast as the elevator car.

Advances in elevator technology have led to the development of machine-room-less (MRL) elevator installations. As this name implies, this type of elevator mechanical system does not employ machine rooms at all. The MRL elevator applications have the goal of reducing the amount of building space occupied by the elevator systems, thereby increasing the amount of usable space on the floors. Typical MRL elevator systems employ a 2:1 roping arrangement. However, conventional MRL systems using a 2:1 roping arrangement incur a considerable amount of cost related to the engineering, manufacture and installation due to the mechanical complexity.

Such conventional methods and systems have generally been considered satisfactory for their intended purpose. However, there is still a need in the art for improved elevator systems. The present disclosure provides a solution for this need.

SUMMARY OF THE INVENTION

An elevator system includes an elevator car. A first drive assembly engages a first tension member. The first tension member is coupled to the elevator car and to a first counterweight. A second drive assembly engages a second tension member. The second tension member is coupled to the elevator car and to a second counterweight.

The first tension member can be coupled to the elevator car at a first position and the second tension member can be coupled to the elevator car at a second position opposite the first position. For example, the first and second positions can be on opposed top edges of the elevator car. In certain embodiments, the first and second positions can be diagonally opposed top corners of the elevator car.

The elevator system can include a third drive assembly and a fourth drive assembly. The third drive assembly engages a third tension member coupled to the elevator car and to a third counterweight. The fourth drive assembly engages a fourth tension member coupled to the elevator car and to a fourth counterweight. For example, each of the tension members can be coupled to the elevator car at a respective top corner of the elevator car. In certain embodiments, each of the tension members can be coupled to the elevator car at a respective top edge of the elevator car.

Each of the drive assemblies can include a drive motor mounted in a hoistway above the highest level serviced by the elevator car. Each of the drive assemblies can include a drive sheave mounted for rotation with the drive motor wherein the respective tension member at least partially wraps around the drive sheave. Each of the tension members can pass from the elevator car, over the drive sheave and extend vertically downwards towards the counter weight. Each of the tension members can travel vertically at the same speed as the elevator car in the opposite direction, i.e., in a 1:1 roping arrangement.

Each of the drive motors can be connected to be synchronized with one another to provide even lifting and lowering of the elevator car. A sensor can be operatively coupled to the first and second drive assemblies and positioned therebetween to detect even/uneven lifting and lowering of the elevator car.

An elevator system includes an elevator car and at least one guiderail to guide movement of the elevator car within a hoistway. A plurality of tension members is included each has a first end coupled to a top position of the elevator car and a second end coupled to a counterweight. A plurality of drive assemblies is included wherein each drive assembly has a drive sheave to engage a respective tension member.

These and other features of the systems and methods of the subject disclosure will become more readily apparent to those skilled in the art from the following detailed description of the preferred embodiments taken in conjunction with the drawings.

BRIEF DESCRIPTION OF THE DRAWINGS

So that those skilled in the art to which the subject disclosure appertains will readily understand how to make and use the devices and methods of the subject disclosure without undue experimentation, preferred embodiments thereof will be described in detail herein below with reference to certain figures, wherein.

DETAILED DESCRIPTION OF THE PREFERRED EMBODIMENTS

Figure 1:
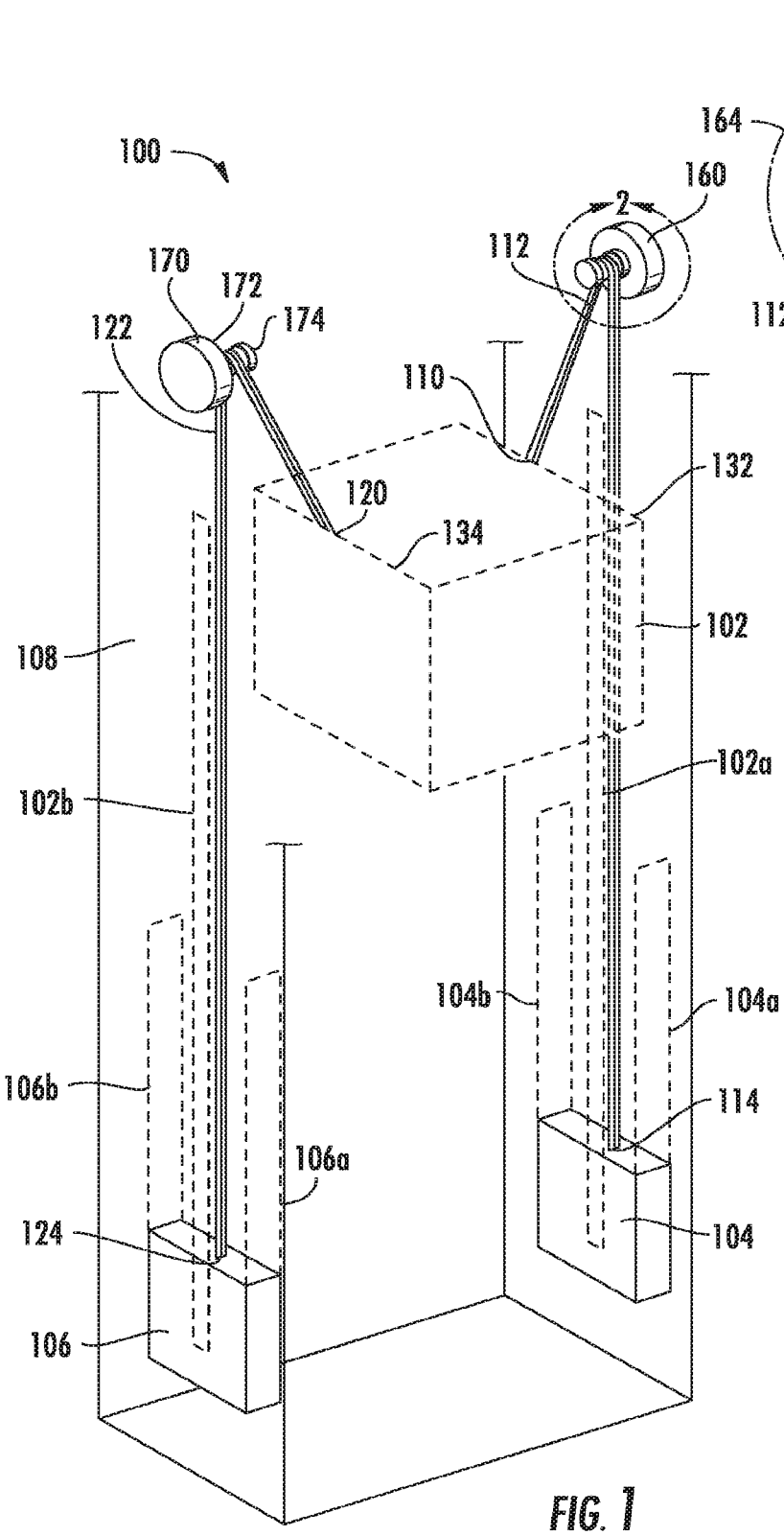
FIG. 1 is a schematic perspective view of an exemplary embodiment of an elevator system constructed in accordance with the present disclosure, showing an elevator car connected to counterweights through respective tension members.

Reference will now be made to the drawings wherein like reference numerals identify similar structural features or aspects of the subject disclosure. For purposes of explanation and illustration, and not limitation, a partial view of an exemplary embodiment of an elevator system in accordance with the disclosure is shown in FIG. 1 and is designated generally by reference character 100. Other embodiments of the elevator system in accordance with the disclosure, or aspects thereof, are provided in FIGS. 2-5, as will be described.

Elevator system 100 includes an elevator car 102 and counterweights 104, 106 in a hoistway 108, part of which is shown as being removed for ease of illustration. The elevator car 102 moves along guide rails 102*a*, 102*b* and counterweights 104, 106 move along guide rails 104*a*, 104*b*, 106*a*, 106*b*, respectively. A plurality of tension members 112, 122 are situated in a 1:1 roping arrangement such that the tension members 112, 122 travel as far as the elevator car 102 in the opposing direction. A first tension member 112 is coupled to the elevator car 102 and to a first counterweight 104. A second tension member 122 is coupled to the elevator car 102 and to a second counterweight. In certain embodiments, the first and second tension members 102, 112 can be a single rope fixedly mounted to the elevator car 102 connecting the first and second counterweights 104, 106 on opposing ends. In another embodiment, a first end 110 of the first tension member 112 is coupled to the elevator car 102 and a second end 114 of the first tension member 112 is coupled to a first counterweight 104. Similarly, a first end 120 of the second tension member 122 is coupled to the elevator car 102 a second end 124 of the second tension member 122 is coupled to a second counterweight 106. The tension members 112, 122 are suspension elements for carrying the elevator car 102 and counterweights 104, 106. The tension members 112, 122 can be, but are not limited to, round cables, ropes, flat belts, or the like. As with known roping arrangements, each of tension members 112, 122 can include three to six redundant ropes. Three redundant ropes are shown schematically in FIGS. 1-5 for ease of illustration.

The first tension member 112 at least partially wraps around a first drive assembly 160 designed to engage the first tension member 112 such that the elevator car 102 and the first counterweight 104 move vertically in opposite directions. In the same manner, the second tension member 122 at least partially wraps around a second drive assembly 170 designed to engage the second tension member 122 such that the elevator car 102 and the second counterweight 106 move vertically in opposite directions. The first and second tension members 112, 122 are coupled to the elevator car 102 on opposite sides to one another to provide even leveling when lifting and lowering the elevator car 102. As shown in FIG. 1, the first end 110 of the first tension member 112 and the first end 120 of the second tension member 122 are coupled to top edges 132, 134 of the elevator car 102. In another embodiment 300 shown in FIG. 3, the first end 310 of the first tension member 312 and the first end 320 of the second tension member 322 can be coupled to diagonally opposed top corners 331, 335 of the elevator car 102.

The embodiment shown and described above in FIG. 1 permits the elevator car 102 to operate vertically without the need for a separate machine room in an extended overhead space or in a lower pit area. With this configuration, the elevator system 100 provides a machine-room-less (MRL) elevator system 100 which can hoist or lower the elevator car 102 with the rotation of the drive assemblies 160, 170. Further, this configuration allows for use of several smaller, high volume components which can reduce the costs associated with typical elevator systems in high rise buildings.

Power may be supplied to the elevator car 102 and driving assemblies 160, 170 by means of any suitable power supply arrangements, for example, a traveling cable running between the elevator car 102 and a power connection point on the elevator wall, or the like.

Figure 4:
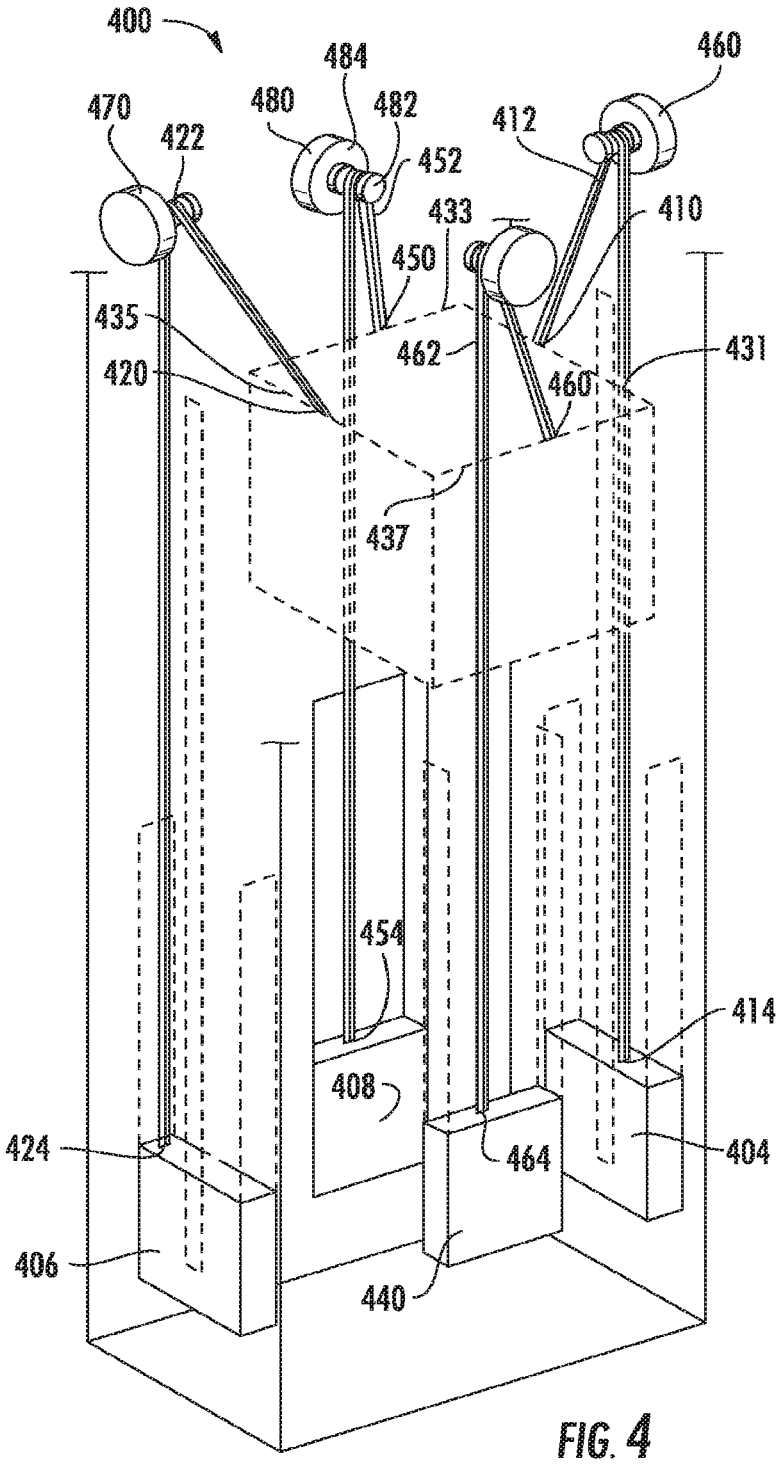
FIG. 4 is a schematic perspective view of a another embodiment of the elevator system of FIG. 1, showing a third and fourth tension member connected to the elevator car at top edges.
Figure 5:
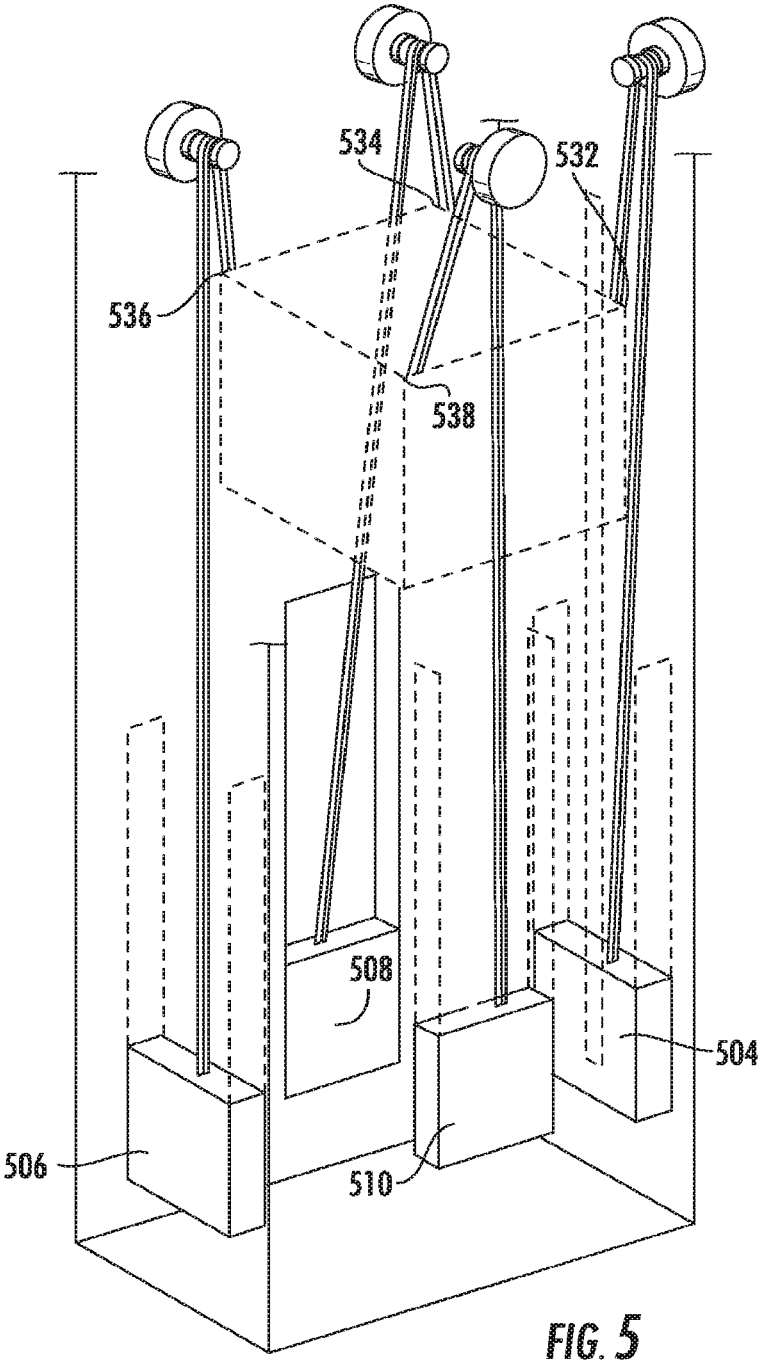
FIG. 5 is a schematic perspective view of an additional embodiment of the elevator system of FIG. 3, showing the third and fourth tension members connected to the elevator car at top corners.
Figure 6:
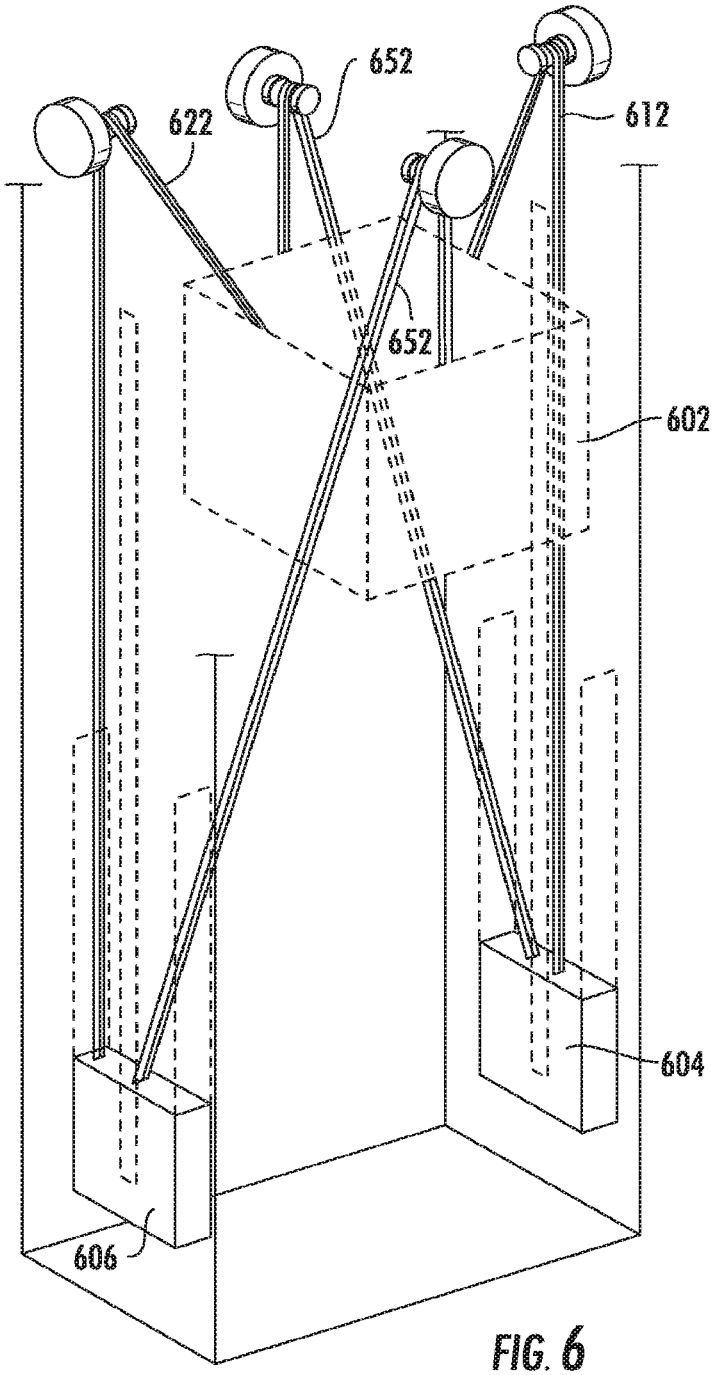
FIG. 6 is a schematic perspective view of an additional embodiment of the elevator system of FIG. 4, showing the first and third tension members connected to a first counterweight and the second and fourth tension members connected to second counterweight.

With reference to FIGS. 4 and 5 additional embodiments 400, 500 of the elevator system are shown. In the embodiments shown in FIGS. 4 and 5, a third tension member 452 and a fourth of tension member 462 are used in conjunction with the first and second tension members 412, 422 to provide additional leveling and improved ride quality. Respective first ends 450, 460 of the third and fourth tension members 452, 462 are coupled to the elevator car 402 and respective second ends 454, 464 of the third and fourth tension members 452, 462 are coupled to third and fourth counterweights 408, 410. With reference to FIG. 4, each of the respective tension members 412,422, 452, 462 are coupled to the elevator car 402 at respective top edges 431, 433, 435, 437. With reference to FIG. 5, each of the respective tension members 512,522, 552, 562 are coupled to the elevator car 502 at respective top corners 532, 534, 536, 538. As shown in FIGS. 4 and 5, each tension member 412, 422, 452, 462 connects the elevator car 402 with a respective counterweight 404, 406, 408 and 409, however in another embodiment, multiple tension members can utilize the same counterweight. For example, as shown in FIG. 6, the first and third tension members 612 and 652 connect the elevator car 602 to the first counterweight 604. The second and fourth tension members 622 and 652 connect the elevator car to the second counterweight 606.

Figure 2:
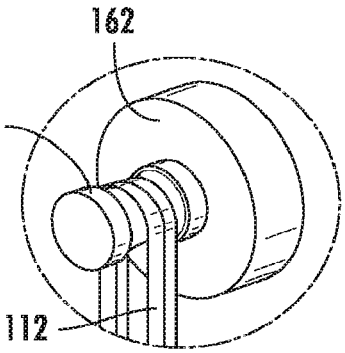
FIG. 2 is a schematic perspective view of a portion of a drive assembly of FIG. 1, showing the tension member wrapped around a drive sheave connected to a drive motor.
Figure 3:
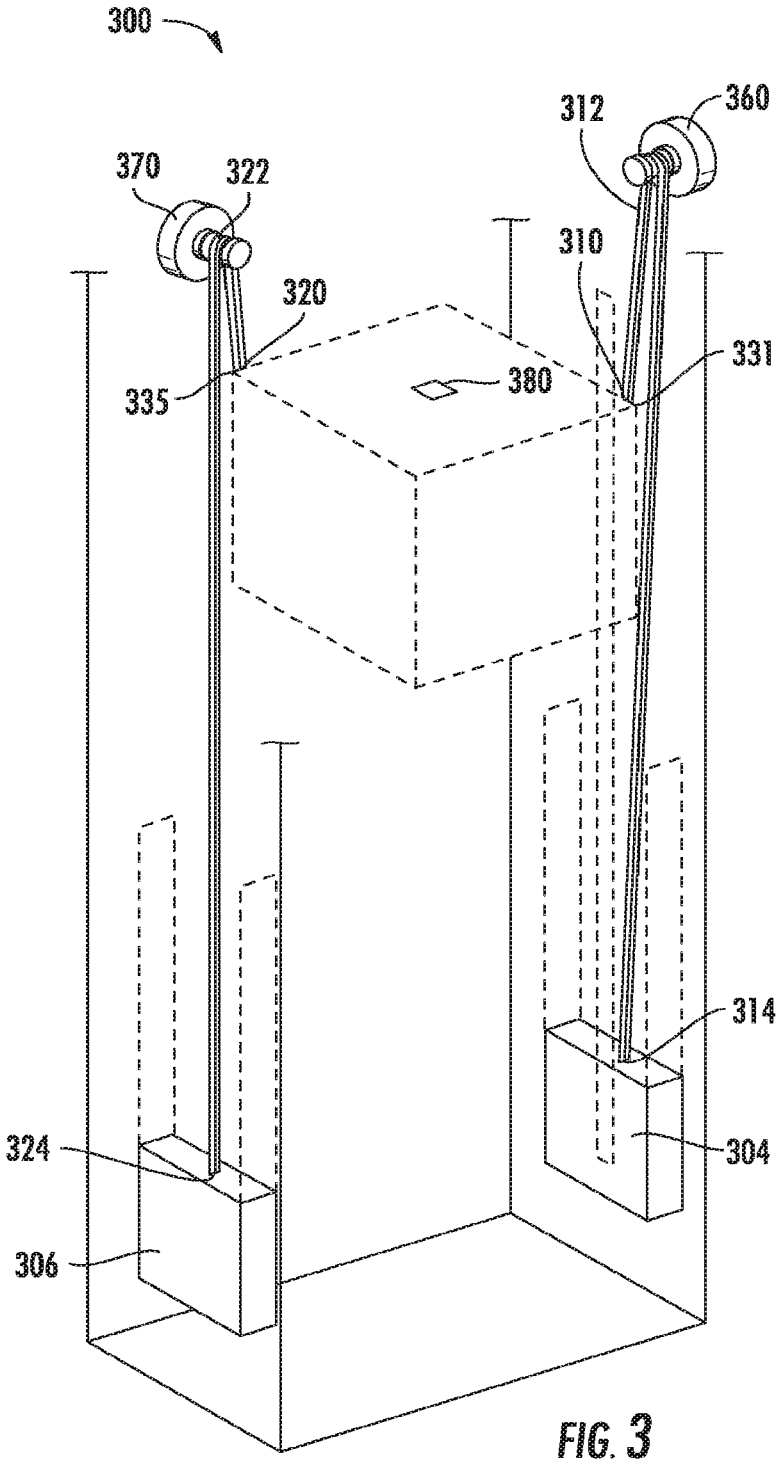
FIG. 3 is a schematic perspective view of another embodiment of the elevator system of FIG. 1, showing the tension members connected to the elevator car at diagonally opposed top corners.

With reference now to FIG. 2 a detailed view of the first drive assembly 160 is shown. As shown, the first drive assembly 160 includes a first drive motor 162 and a first drive sheave 164 mounted for rotation with the first drive motor 162. The first drive assembly 160 is mounted in the hoistway 108 above the highest level serviced by the elevator car 102 such that the first tension member 112 extends upward from the top of the elevator car 102, passes once over the drive sheave 164, and extends vertically downward towards the first counterweight 104. In this manner, the first tension member 112 follows a single wrap configuration and travels vertically at the same speed as the elevator car 102 in the opposite direction in a 1:1 roping arrangement. Those skilled in the art will readily appreciate that the roping arrangement of each tension member is the same between each tension member and respective drive assembly shown in FIGS. 3-5 as in that described above with respect to FIGS. 1 and 2.

To provide even lifting and lowering of the elevator car during use each of the drive motors can be connected to be synchronized to one another. A sensor 380 (shown schematically in FIG. 3) can be operatively coupled to the each of the drive assemblies to detect even/uneven lifting and lowering of the elevator car. Each motor of the drive assemblies can include some control functionality, however, the system includes one controller operatively connected to each drive assembly for control of the elevator car.

Figure 7:
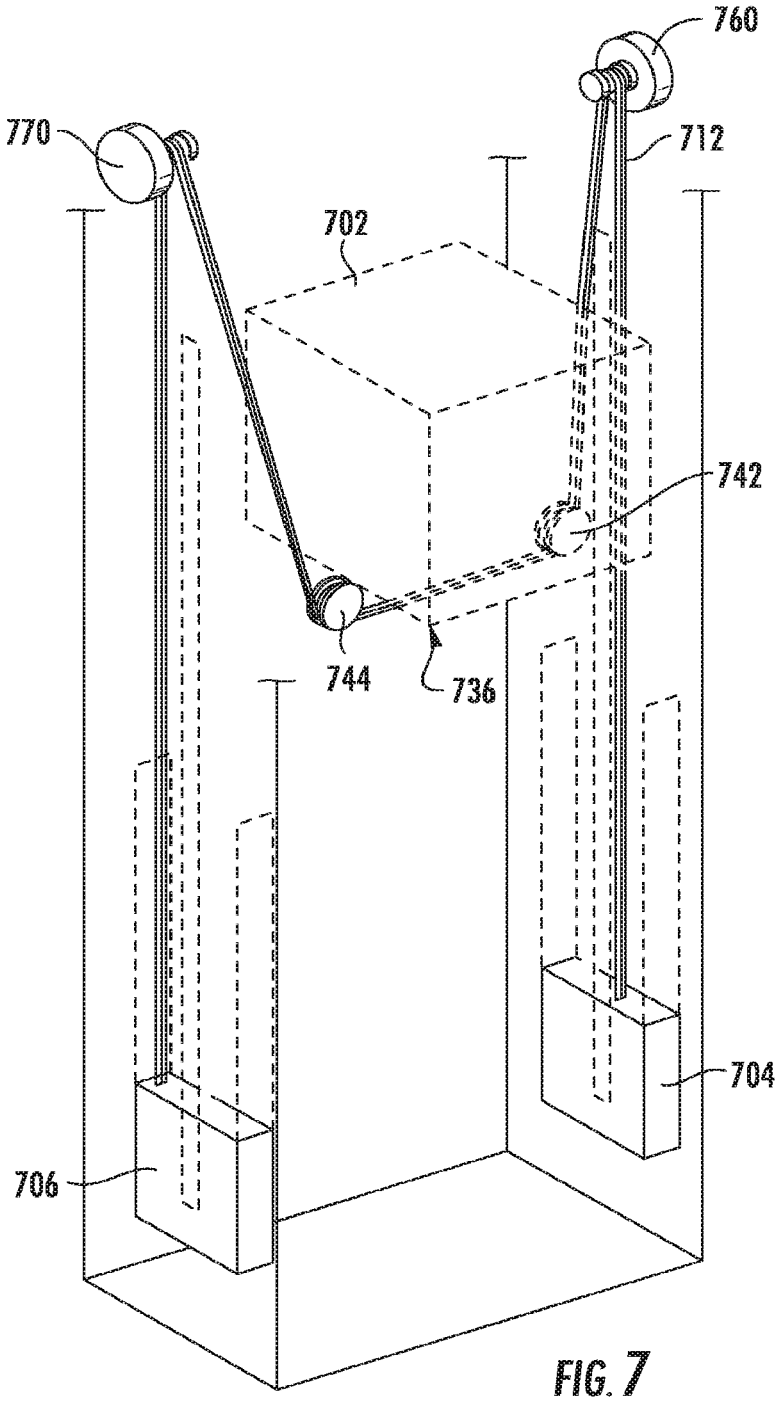
FIG. 7 is a schematic perspective view of an additional embodiment constructed in accordance with the present disclosure, showing an elevator car connected to counterweights through a respective tension member connected to idler sheaves on a bottom surface of the elevator car.

With reference to FIG. 7, another embodiment of system is shown. System consists of one set of tension members 712 which extend from a first counterweight 704 around a first drive assembly 760 down towards a first idler sheave 742. The first idler sheave 742 is positioned on a bottom surface 736 of the elevator car 702. A second idler sheave 744 is positioned on the bottom surface 736 of the elevator car on an opposing edge from the first idler sheave 742. The tension members 712 loop under the elevator car 702 from the first idler sheave 742 to the second idler sheave 744 and up towards the second drive assembly 770. From the second drive assembly 770 the tension members 712 extend towards the second counterweight 706. In this embodiment, instead of terminating the tension members 712 directly on the elevator car 702, the tension members 712 loop underneath the elevator car 702. This has the advantage of relaxing some of the synchronization requirements between the first and second drive assemblies.

With the roping arrangement and driving assemblies described above, the present disclosure makes possible for one motor size to be used for all elevator cars regardless of the number of floors the elevator car services. For instance, a high rise building having two elevator cars servicing floors 1-15 may have one elevator car using two motors to service floors 1-5. The second elevator car may employ four motors to service floors 6-15. In this manner, only one motor size is needed to support all elevator cars throughout the building.

The methods and systems of the present disclosure, as described above and shown in the drawings, provide for an elevator system roping arrangement with superior properties including an improved 1:1 roping arrangement for machine-room less elevator cars. The methods and systems can be used conventional elevator systems and machine room less elevator systems. While the apparatus and methods of the subject disclosure have been shown and described with reference to preferred embodiments, those skilled in the art will readily appreciate that changes and/or modifications may be made thereto without departing from the spirit and scope of the subject disclosure.

What is claimed is:

1. An elevator system, comprising:

an elevator car;

a first drive assembly that engages a first tension member coupled to the elevator car and coupled to a first counterweight; and a second drive assembly that engages a second tension member coupled to the elevator car and coupled to a second counterweight;

a third drive assembly that engages a third tension member coupled to the elevator car and coupled to the first counterweight;

a fourth drive assembly that engages a fourth tension member coupled to the elevator car and coupled to the second counterweight, wherein the first tension member is coupled to the elevator car at a first position and the second tension member is coupled to the elevator car at a second position opposite the first position, wherein the third tension member is coupled to the elevator car at a third position adjacent the first and second positions, wherein the fourth tension member is coupled to the elevator car at a fourth position, opposite the third position and adjacent the first and second positions, wherein the first and second positions are on top edges of the elevator car;

wherein each of the drive assemblies include a drive motor; and a sensor operatively coupled to the first, second, third, and fourth drive assemblies and positioned therebetween to detect uneven lifting and lowering of the elevator car, wherein each motor of the first, second, third, and fourth drive assemblies include independent control of the drive assemblies based on sensor data from the sensor such that the motors are synchronized with one another to provide even lifting and lowering of the elevator car.

2. The system of claim 1, wherein each respective motor is mounted in a hoistway above the highest level serviced by the elevator car.

3. The system of claim 1, wherein each of the drive assemblies includes a drive sheave mounted for rotation with the drive motor wherein the respective tension members at least partially wraps around the drive sheave.

4. The system of claim 3, wherein each of the tension members passes over the drive sheave once and extends vertically downwards towards the respective counter weight.

5. The system of claim 1, wherein each of the tension members travels vertically at the same speed as the elevator car in the opposite direction.

6. An elevator system, comprising:

an elevator car;

at least one guiderail to guide movement of the elevator car within a hoist way;

a plurality of tension members each tension member having a first end coupled to a top position of the elevator car and a second end coupled to a counterweight;

a plurality of drive assemblies each drive assembly having a drive sheave to engage a respective tension member, wherein each of the plurality of drive assemblies include a motor; and a sensor operatively coupled to each of the plurality of drive assemblies and positioned therebetween to detect uneven lifting and lowering of the elevator car, wherein each motor of the plurality of drive assemblies include independent control of the drive assemblies based on sensor data from the sensor such that the motors are synchronized with one another to provide even lifting and lowering of the elevator car.

7. The system of claim 6, wherein each of the tension members are coupled to the elevator car at a respective top edge of the elevator car.

8. The system of claim 6, wherein each of the motors of the plurality of drive assemblies are mounted in the hoistway above the highest level serviced by the elevator car.

* * * * *